US010653940B2

(12) United States Patent
Barthold et al.

(10) Patent No.: US 10,653,940 B2
(45) Date of Patent: May 19, 2020

(54) TOY RING STAGE

(75) Inventors: Mark Barthold, Torrance, CA (US); William Miekina, Redondo Beach, CA (US)

(73) Assignee: Mattel, Inc., El Segundo, CA (US)

( * ) Notice: Subject to any disclaimer, the term of this patent is extended or adjusted under 35 U.S.C. 154(b) by 2345 days.

(21) Appl. No.: 13/397,187

(22) Filed: Feb. 15, 2012

(65) Prior Publication Data

US 2012/0208427 A1 Aug. 16, 2012

Related U.S. Application Data

(60) Provisional application No. 61/443,537, filed on Feb. 16, 2011.

(51) Int. Cl.
*A63C 19/00* (2006.01)
*A63H 33/42* (2006.01)

(52) U.S. Cl.
CPC ..... *A63C 19/005* (2013.01); *A63H 33/42* (2013.01)

(58) Field of Classification Search
CPC ..... A63C 19/005; A63H 13/00; A63H 13/04; A63H 13/06; A63H 33/30; A63H 33/42; A63F 7/2472
USPC ..... 446/322–336; 403/43–48; 472/93
See application file for complete search history.

(56) References Cited

U.S. PATENT DOCUMENTS 485,896 A * 11/1892 Sterry, Jr. ..... A63C 19/005 472/93
1,490,091 A * 4/1924 Carver ..... 403/46
1,876,720 A * 9/1932 Merrill ..... 29/896.7
2,496,725 A * 2/1950 Hotcaveg ..... 446/335
2,716,840 A * 9/1955 Armstrong ..... A63H 13/06 446/334
2,726,866 A * 12/1955 Nally ..... A63C 19/005 472/93
2,832,174 A * 4/1958 Yip ..... 446/75
3,876,197 A * 4/1975 Jenson ..... A63C 19/005 472/93
4,057,245 A * 11/1977 Gordon ..... 482/17
4,091,563 A * 5/1978 Noble et al. ..... 273/440.1
4,710,049 A * 12/1987 Chang ..... A47D 13/063 16/250
5,042,099 A * 8/1991 Brenner et al. ..... 5/502
5,160,284 A * 11/1992 Krom ..... 439/797
6,254,532 B1 * 7/2001 Paolitto et al. ..... 600/201
(Continued)

OTHER PUBLICATIONS

Wikipedia—"Turnbuckle" (https://web.archive.org/web/20100331101354/http://en.wikipedia.org/wiki/Turnbuckle), Mar. 31, 2008.*

*Primary Examiner* — Eugene L Kim
*Assistant Examiner* — Alyssa M Hylinski
(74) *Attorney, Agent, or Firm* — Edell, Shapiro & Finnan, LLC

(57) ABSTRACT

A play set has a toy ring stage including a raised platform with vertical posts, a ring mat, and a ring skirt partially attached to the platform. The play set includes a horizontal ring rope attached to the at least four posts to complete a wrestling or boxing ring stage. A turnbuckle is provided for attaching the rope to the post. In one embodiment, a sheath covers the turnbuckle. In one embodiment, a turnbuckle pad is used to cover the turnbuckle. The turnbuckle pad includes two dimples for contouring the pad to the rope.

9 Claims, 5 Drawing Sheets

(56) References Cited

U.S. PATENT DOCUMENTS

| | | | | |
|---|---|---|---|---|
| 6,325,692 | B1 * | 12/2001 | Webb | A63H 33/00 446/490 |
| 6,340,334 | B1 * | 1/2002 | Olsen | A63C 19/005 472/92 |
| 6,557,193 | B1 * | 5/2003 | Griffith | 5/493 |
| 6,725,970 | B2 * | 4/2004 | Garofalo | 182/115 |
| 8,808,054 | B1 * | 8/2014 | Barthold | A63H 33/42 446/309 |
| 2003/0132335 | A1 * | 7/2003 | Schmidt | B65H 59/22 242/419.4 |
| 2008/0256760 | A1 * | 10/2008 | Kavanaugh | 24/115 R |
| 2010/0115739 | A1 * | 5/2010 | Mathur | A45F 5/02 24/306 |
| 2013/0017895 | A1 * | 1/2013 | Mechling | A41D 13/0543 472/93 |

* cited by examiner

TOY RING STAGE

CROSS-REFERENCE TO RELATED APPLICATION

This application claims priority to and is based on U.S. Provisional Patent Application Ser. No. 61/443,537, filed Feb. 16, 2011, entitled "Toy Ring Stage," the disclosure of which is incorporated herein by reference in its entirety.

FIELD OF THE INVENTION

The invention relates generally to a play set apparatus for boxing, wrestling or the like. The apparatus provides a novel toy ring stage including various play elements and improvements over the prior art, which allow for more diverse and realistic play.

BACKGROUND

Wrestling and boxing have long been a staple in providing hours of fun and entertainment for children and adults. Toy wrestling and boxing action figures and play pieces have allowed wrestling and boxing fans to reenact and create wrestling and boxing matches that resemble real-life wrestling and/or fighting activities. As wrestling continues to increase in popularity, so does the desire to have more play opportunities and apparatus that better mimic action in the wrestling ring. Signature moves created by various wrestlers, such as Sweet Chin Music (by Shawn Michaels) or the Lariant Clothesline (by Lance Cade), require specific elements of the wrestling ring stage to be properly replicated, and often call for certain details of the wrestling ring stage that are not easily implemented in a scaled toy version. Accordingly, it is desirable to provide a toy ring stage apparatus that allows for accurate enactment of wrestling and fighting activities. It is also desirable to provide a toy ring stage apparatus that presents multiple play elements, increasing an end user's interaction with the toy ring stage, and encouraging imaginative play.

SUMMARY

In one embodiment a play set is provided, the play set having a toy ring stage comprising a raised platform having at least four vertical posts, a ring mat a top the platform and a ring skirt partially attached to the platform. The play set further comprises a horizontal ring rope attached to the at least four posts to complete a wrestling or boxing ring stage.

In an embodiment of the invention, a tensioned rope is slideably attached to the at least four ring posts by a turnbuckle, wherein the tensioned rope is attached to each of the at least four ring posts to create a taut ring stage. In a further embodiment, the turnbuckle is adjustable.

In another embodiment, the turnbuckle is covered by a removable sheathing, capable of covering the turnbuckle and easily removable to provide access for adjusting the turnbuckle. In a further embodiment, the sheathing is configured to cover a portion of the turnbuckle.

In one embodiment of the present invention, the attachment point of the turnbuckle to the rope is covered by a turnbuckle pad. The turnbuckle pad may be removably attached, and is configured to cover the end of the turnbuckle as well as a portion of the rope. In a further embodiment, the turnbuckle pad is shaped to cover the rope and turnbuckle combination without pinching or deforming the turnbuckle pad.

In yet another embodiment of the present invention, the ring skirt is partially attached to the ring stage platform, allowing for a separation between the fabric of the ring skirt and platform. By way of example, the ring skirt may be attached to the platform at the four corners of a square or rectangular ring stage, allowing for separation of the ring skirt from the platform between the four posts.

In one embodiment, a toy ring comprises a platform; a plurality of posts attached to the platform; a rope coupled to each of the posts; and a turnbuckle pad removably mounted to the rope at the attachment point between the rope and one of the posts, the turnbuckle pad being formed to facilitate placement of the turnbuckle pad on the rope, the turnbuckle pad including a first end portion, a second end portion opposite the first end portion, and a removable coupler for mounting the turnbuckle pad to the rope, the coupler including a shaft that engages the first end portion and the second end portion of the turnbuckle pad to couple them together.

In one alternative, the toy ring comprises a turnbuckle coupleable to the rope and one of the posts to couple the rope to the post.

In another alternative embodiment, the toy ring comprises a sheathing substantially covering the turnbuckle.

In another alternative embodiment, the toy ring comprises a ring skirt partially attached to the platform.

In another alternative embodiment, the ring skirt is removably coupleable to the platform, thereby creating a gap between the platform and ring skirt when the ring skirt is removed from the platform.

In another alternative embodiment, the turnbuckle pad includes two side portions, each of the side portions including a dimple for contouring the turnbuckle pad to the rope.

In another alternative embodiment, each of the first end portion and the second end portion of the turnbuckle pad includes a pair of openings, and the shaft engages one of each of the pairs of openings to mount the turnbuckle pad around the rope.

In another alternative embodiment, the coupler includes a base and at least two pegs coupled to the base and extending substantially therefrom, one of the pegs including the shaft.

In another alternative embodiment, each peg is passed through an opening in each of the first end portion and the second end portion of the turnbuckle pad when the turnbuckle pad is mounted to the rope.

In one embodiment, a toy ring comprises a platform; at least one post coupled to the platform and extending substantially vertically therefrom; a turnbuckle removably coupled to the post, the turnbuckle including a first loop portion and second loop portion, the first loop portion being engageable with the post; a rope coupled to the turnbuckle, the rope being engageable with the second loop portion of the turnbuckle; and a turnbuckle pad removably mounted to the rope at the attachment point between the rope and post, the turnbuckle pad being located so as to cover a portion of the rope and the second loop portion of the turnbuckle.

In an alternative embodiment, the toy ring comprises a sheathing substantially covering the turnbuckle.

In another alternative embodiment, at least a portion of the sheathing is covered by the turnbuckle pad when the turnbuckle pad is mounted to the rope.

In another alternative embodiment, one of the first loop portion or the second loop portion is movable relative to the turnbuckle.

In another alternative embodiment, the first loop portion has a different configuration than the second loop portion.

In another alternative embodiment, the turnbuckle pad comprises two dimples for contouring the turnbuckle pad to the rope at the attachment point between the rope and the turnbuckle.

In another alternative embodiment, the turnbuckle pad includes two side portions, and each of the side portions includes one of the dimples.

In another alternative embodiment, the turnbuckle pad includes two pairs of corresponding openings at opposing ends of the turnbuckle pad for mounting the turnbuckle pad around the attachment point between the rope and the turnbuckle.

In another alternative embodiment, the toy ring comprises a fastener for assembling the turnbuckle pad, the fastener including a base and at least two pegs attached to the base, the pegs being insertable into the openings at the opposite ends of the turnbuckle pad to couple the ends of the turnbuckle pad together.

In one embodiment, a toy ring comprises a platform; a plurality of posts coupled to the platform; a plurality of turnbuckles, each turnbuckle having a first end and a second end opposite to its first end, each turnbuckle including a first connector at its first end and a second connector at its second end, the first connector of each turnbuckle being removably coupled to one of the posts; a rope coupled to each of the turnbuckles, the rope being engageable with the second connector of each of the turnbuckles; and a plurality of turnbuckle pads, each of the turnbuckle pads being removably mounted to the rope at the location where the rope engages one of the turnbuckles, each of the turnbuckle pads having angled side portions with dimples formed therein that facilitate the mounting of the turnbuckle pad to the rope.

In an alternative embodiment, each of the turnbuckle pads includes a first end, a second end opposite to its first end, and a coupler with multiple posts, the posts of each coupler being engageable with a first end and a second end of a turnbuckle pad to couple the ends of the turnbuckle pad together about the rope.

Other objects, features and advantages of the invention will be understood more readily after consideration of the Detailed Description taken in connection with the accompanying drawings.

DETAILED DESCRIPTION

Figure 1:
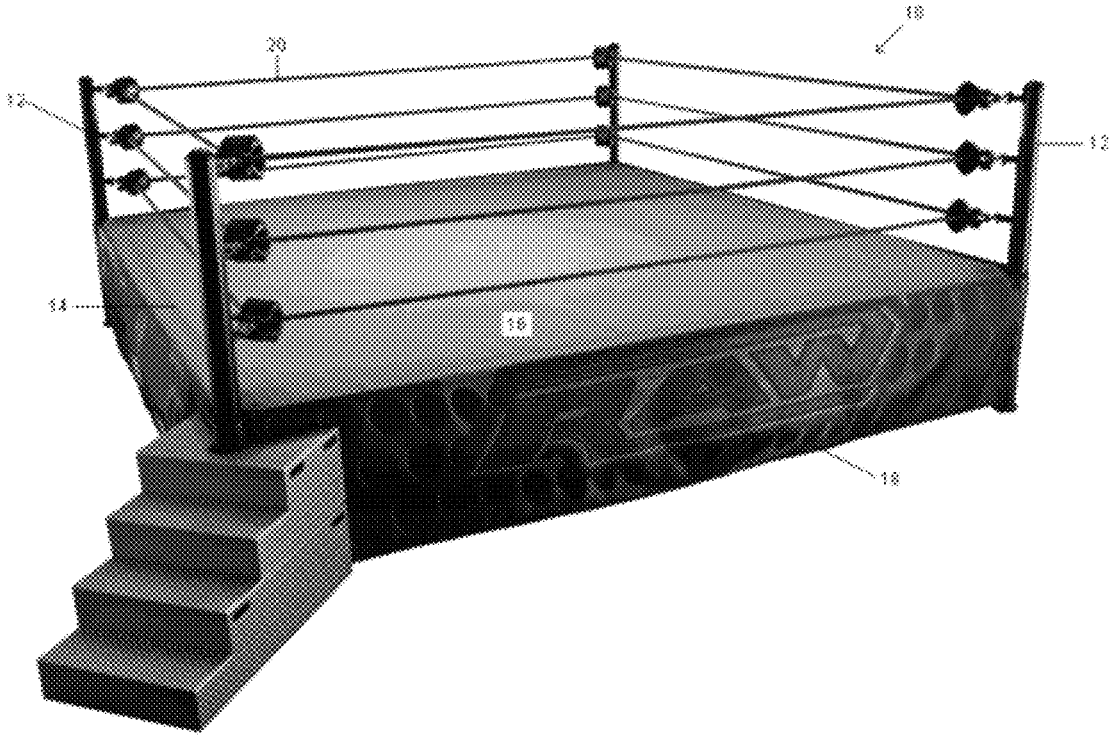
FIG. 1 is a side perspective view of a toy ring stage in accordance with an embodiment of the present invention.

FIG. 1 illustrates a side perspective view of a toy ring stage 10 in accordance with an embodiment of the present invention. The ring stage 10 comprises a raised platform 14 upon which the wrestling or boxing event takes place. The ring stage 10 further comprises a ring mat 16 sitting atop the platform 14, as well as four posts 12 vertically attached at various locations around the periphery of the platform 14 to encompass the ring mat 16. At least two ropes 20 are anchored to the four posts 12 and configured in the vertical axis at increased distances from the ring mat 16 to complete the ring stage 10. In one embodiment, the platform 14 and ring mat 16 are rectangular in shape, and each of the four posts 12 are attached at one of the four corners of the rectangle. In the depicted embodiment, the ring stage 10 comprises three ropes 20, and their corresponding attachment points to the post 12. The platform 14 and posts 12 may be fabricated from any suitable material, or combination of materials, such as plastic, foamed plastic, wood, cardboard, pressed paper, metal, or the like. Suitable plastics may include high-density polyethylene (HDPE), low-density polyethylene (LDPE), polystyrene, acrylonitrile butadiene styrene (ABS), polycarbonate, polyethylene terephthalate (PET), polypropylene, ethylene-vinyl acetate (EVA), or the like. Suitable foamed plastics may include expanded or extruded polystyrene, expanded or extruded polypropylene, EVA foam, or the like. The ring mat 16 and ring skirt 18 may be fabricated from any suitable material, or combinations of materials, such as supple natural or synthetic materials including, but not limited to, cotton, elastomers, polyester, or derivatives thereof.

Figure 2:
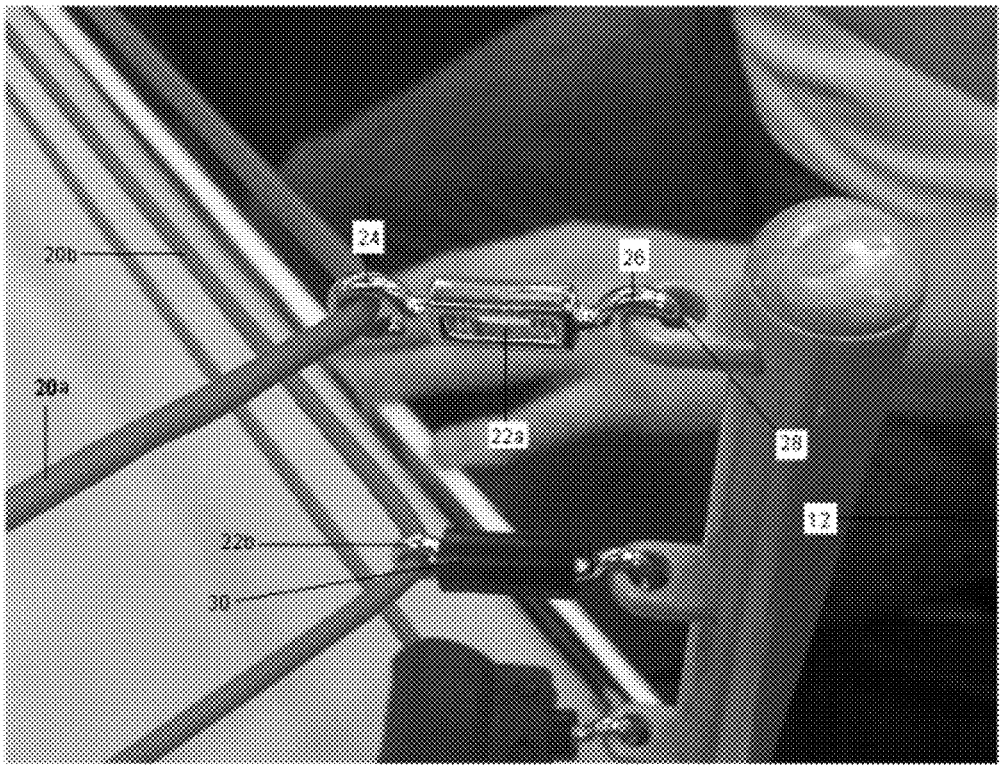
FIG. 2 is a top perspective view of a turnbuckle, rope, and post assembly in accordance with an embodiment of the present invention.

FIG. 2 is a top perspective view of a turnbuckle 22, rope 20, and post 12 assembly in accordance with an embodiment of the present invention. FIG. 2 depicts a detailed view of one corner of the ring stage 10 showing various elements in the attachment of the rope 20 to the post 12, via the turnbuckle 22. A top rope assembly depicts the top rope 20*a*, with the top turnbuckle 22*a* having a first open-loop or hook 24 and a second open-loop or hook 26. Each of the hooks 24 and 24 defines a loop or receiving area and can be referred to alternatively as a connector or connecting portion. The top rope 20*a* is slideably attached to the top turnbuckle 22*a* by capturing the top rope 20*a* in the first open-loop 24. The turnbuckle 22 is further attached to the post 12 by attaching the second open-loop 26 to an opening 28 found on a tab extending from post 12. The center rope assembly includes the center turnbuckle 22*b*, center rope 20*b*, and post 12 assembly. The center rope assembly further illustrates a sheathing 30 substantially covering the center turnbuckle 22*b*. Sheathing 30 may be configured to substantially cover the elongate portion of the turnbuckle 22 and encompass the first open-loop 26 and/or second open-loop 28, thus preventing disengagement of the rope 20, turnbuckle 22 or post 12 assembly. The turnbuckle 22, rope 20, and post 12 assembly is configured to provide a taut rope construction when the rope is attached to all four posts 12. The turnbuckle 22 and sheathing 30 may be fabricated from any suitable material, or combination of materials, such as plastic, foamed plastic, ABS, wood, cardboard, pressed paper, metal, or the like. The rope 20 may be fabricated from any suitable resilient material, or combinations of materials, such as, cotton, elastomers, polyester, and/or derivatives thereof.

Figure 3:
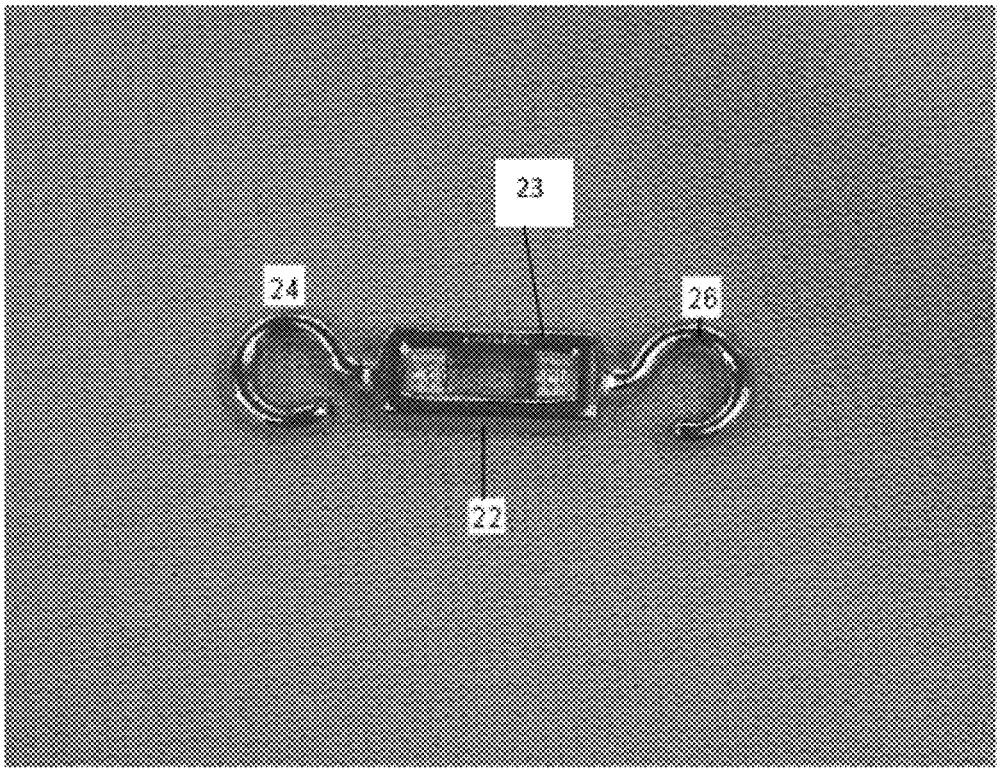
FIG. 3 is a side perspective view of a turnbuckle in accordance with an embodiment of the present invention.

FIG. 3 is a side perspective view of a turnbuckle 22 in accordance with an embodiment of the present invention, and details an elongate portion 23, the first open-loop 24 and second open-loop 26. In one embodiment, the outer circumference of the first open-loop 24 may be larger than the outer circumference of the second open-loop 26. In another embodiment, the outer circumference of the first open-loop 24 may be smaller than the outer circumference of the second open-loop 26. The first open-loop 24 allows for easy attachment of the rope to the turnbuckle 22, and is configured to allow the rope 20 to slide about the first open-loop 24. The second open-loop 26 is configured for easy attachment of the turnbuckle 22 to the ring post 12. In one embodiment, the inner circumference of the first open-loop 24 is greater than the outer circumference of the rope 20. The opening of first open-loop 24 is just large enough to accommodate rope 20. In yet another embodiment, the elongate portion 23 is configured to allow for adjustment of the length of the turnbuckle 22 by rotating the elongate portion 23 with respect to the first open-loop 24 and second open-loop 26.

Figure 4:
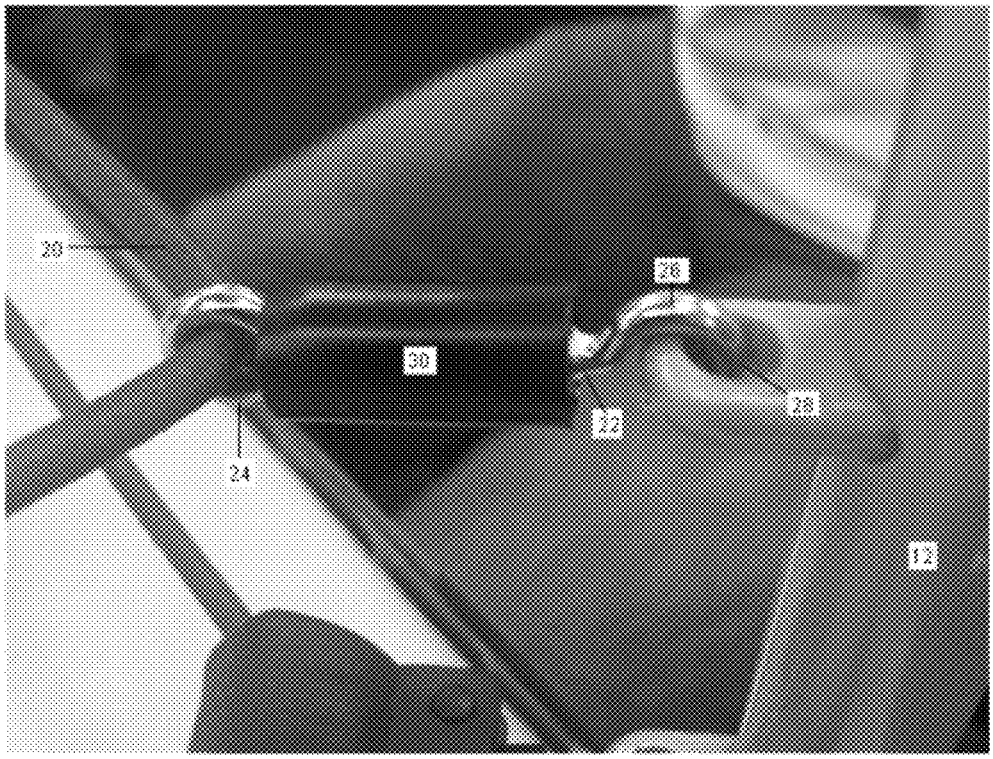
FIG. 4 is a top perspective view of a turnbuckle, rope, post, and sheathing assembly in accordance with an embodiment of the present invention.

FIG. 4 is a top perspective view of a turnbuckle 22, rope 20, post 12, and sheathing 30 assembly in accordance with an embodiment of the present invention. FIG. 4 depicts the rope 20 attached to a turnbuckle 22 having a first open-loop 24 and second open-loop 26. The rope 20 is slideably attached to the turnbuckle 22 by capturing the rope 20 in the first open-loop 24. The turnbuckle 22 is further attached to the post 12 by attaching the second open-loop 26 to an opening 28 found on the post 12. The sheathing 30 slideably covers the elongate portion 23 of the turnbuckle 22 and may encompass a portion of the first open-loop 26, preventing the rope from disengaging the turnbuckle 22. In an alternative embodiment, the sheathing 30 may be configured to cover the elongate portion 23 of the turnbuckle 22 and a portion of both the first open-loop 24 and second open-loop 26. In yet another embodiment, the inner circumference of the sheathing may be greater or equal to the outer circumference of the first open-loop 24 and outer circumference of the second open-loop 26, to allow for removal and adjustment of the sheathing 30 upon the turnbuckle 22.

Figure 5:
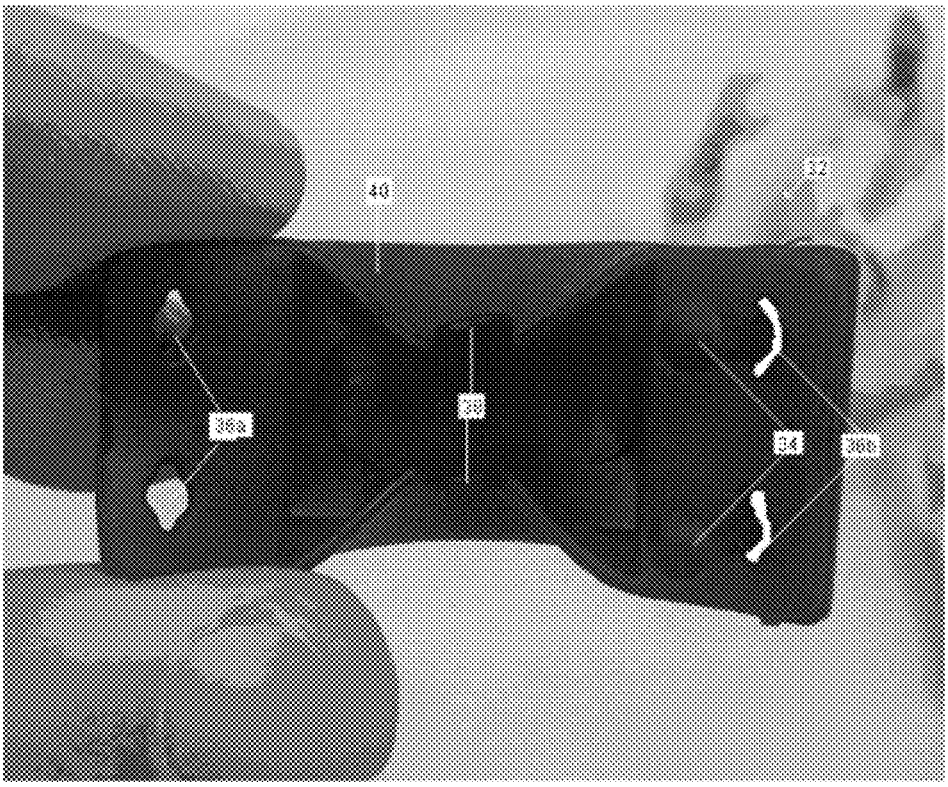
FIG. 5 is a rear perspective view of a turnbuckle pad in accordance with an embodiment of the present invention.
Figure 6:
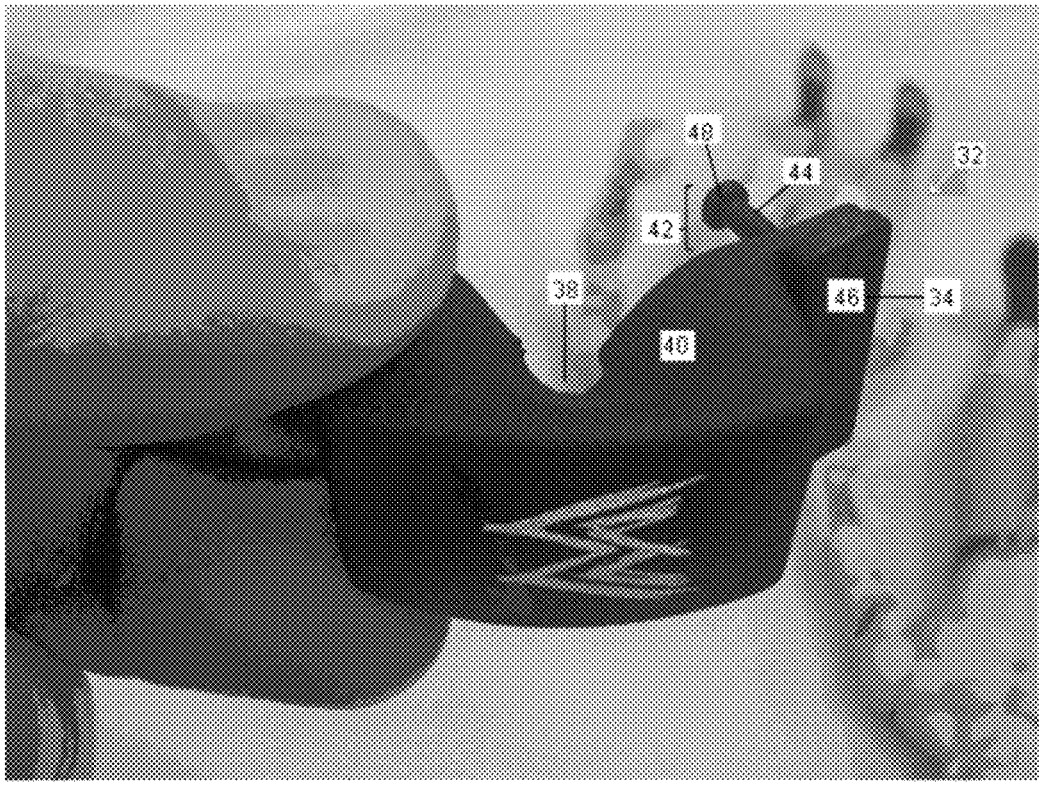
FIG. 6 is a side perspective view of a turnbuckle pad in accordance with an embodiment of the present invention.
Figure 7:
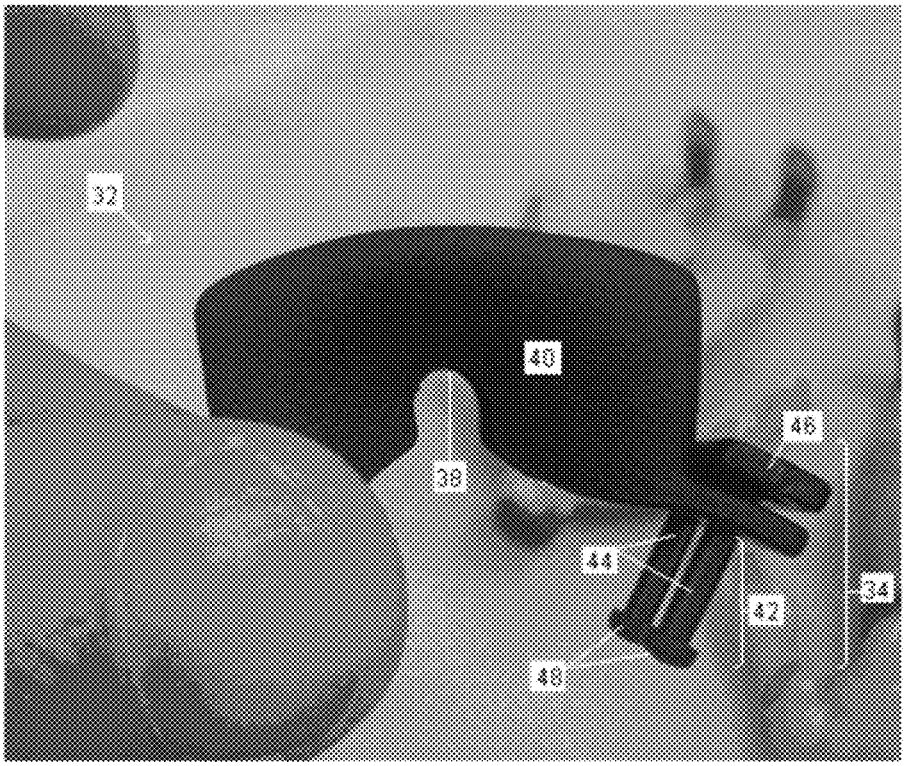
FIG. 7 is a side perspective view of a turnbuckle pad in accordance with an embodiment of the present invention.

FIGS. 5, 6 and 7 depict various views of a turnbuckle pad 32 in accordance with an embodiment of the present invention. The turnbuckle pad 32 is configured to attach and cover the approximately ninety degree junction created by the turnbuckle 22 to rope 20 assembly. In order to properly contour the turnbuckle pad 32 around the turnbuckle 22 to rope 20 assembly, the pad 32 is configured with two dimples 38 found about the mid-line of the pad 32 to assemble contiguous to the rope 20 at about the ninety degree junction. As depicted in FIG. 6, the turnbuckle pad 32 is molded such that the side portions 40, adjacent to the dimples 38, fold inwardly and not outwardly to contour to the ninety degree junction created by the rope 20, when the pad 32 is attached to the turnbuckle 22 to rope 20 assembly. The folded side portions 40 facilitate the mounting of the turnbuckle pad 32 to the rope 20. The turnbuckle pad 32 further comprises a first pair of fissures or openings 36*a*, and a second pair of fissures or openings 36*b*, with the first pair of fissures 36*a* and second pair of fissures 36*b* situated at opposing ends of the turnbuckle pad 32. The fissures 36*a* and 36*b* are configured to overlap and align with one another as the turnbuckle pad 32 is assembled to encapsulate the turnbuckle 22 to rope 20 assembly. The turnbuckle pad 32 is shaped and molded to contour to the rope and turnbuckle 22 assembly using conventional, or a combination of conventional, manufacturing methods, including blow molding, CNC machining, centrifugal casting, continuous strip molding, compression molding, profile extrusion, continuous lamination, injection molding, filament winding, thermoforming, vacuum forming, pressure bag molding, pressure forming, pulshaping, twin sheet forming, pultrusion, liquid resin molding, reaction injection molding (RIM), rotational molding, and resin transfer molding (RTM).

FIGS. 5 and 7 further depict a fastener or coupler 34 for assembling the turnbuckle pad 32. The fastener 34 comprises a base 46 and at least two pegs 42 fixed substantially perpendicular to the base 46. Each peg 42 has an elongate shaft 44 spanning the length of the peg 42 and a cap 48 concluding the peg 42. The outer circumference of the cap 48 is greater than the outer circumference of the shaft 44, and smaller than the fissures 36 created in the turnbuckle pad 32. In various embodiments of the invention, the fastener 34 may be molded and/or affixed to the turnbuckle pad 32. The turnbuckle pad 32 and fastener 34 may be fabricated from any suitable material, or combination of materials, such as plastic, supple natural or synthetic fibers including, cotton, elastomers, polyester, or derivatives thereof. Suitable plastics may include high-density polyethylene (HDPE), low-density polyethylene (LDPE), polystyrene, acrylonitrile butadiene styrene (ABS), polycarbonate, polyethylene terephthalate (PET), polypropylene, ethylene-vinyl acetate (EVA), or the like. Suitable foamed plastics may include expanded or extruded polystyrene, expanded or extruded polypropylene, EVA foam, or the like.

In assembly, the turnbuckle pad 32 is fitted to the turnbuckle 22 to rope 20 assembly, such that the two dimples 38 encircle the rope 20 with the side portions 40 resting against the rope 20. The pair of fissures 36*a* and 36*b* is then aligned with one another with the aligned fissures situated adjacent to and on each side of the turnbuckle 22. The two pegs 42 of the fastener 34 are passed through both pair of fissures 36*a* and 36*b* until the caps 48 extend beyond the fissures 36, thus framing the turnbuckle 22 (see FIG. 8). In one embodiment, the turnbuckle pad 32 may be configured to frame the turnbuckle 22 and sheathing 30 assembly.

Figure 8:
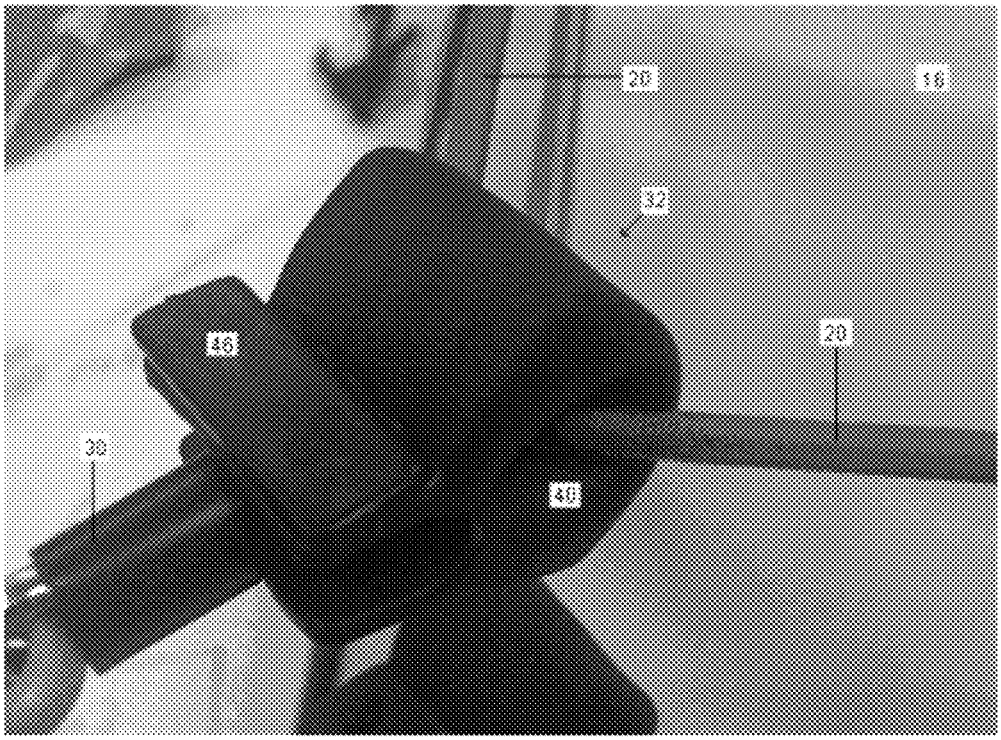
FIG. 8 is a top perspective view of a turnbuckle, rope, sheathing, and turnbuckle pad assembly in accordance with an embodiment of the present invention.

FIG. 8 is a top perspective view of a turnbuckle, rope, sheathing and turnbuckle pad assembly in accordance with an embodiment of the present invention. The assembled turnbuckle pad 32 shows the effect created by the dimples 38 and side portions 40 at the ninety degree junction created by the rope 20. This contoured effect is further aided by the shaped and molded manufacturing method of the turnbuckle pad 32. Further depicted is the proper contouring of the turnbuckle pad 32 around the turnbuckle 22 to post 12 assembly, utilizing the pegs 32 and fissures 36 on each side of the turnbuckle pad 32 to secure the pad 32 to the turnbuckle 22 and sheathing 30.

Figure 9:
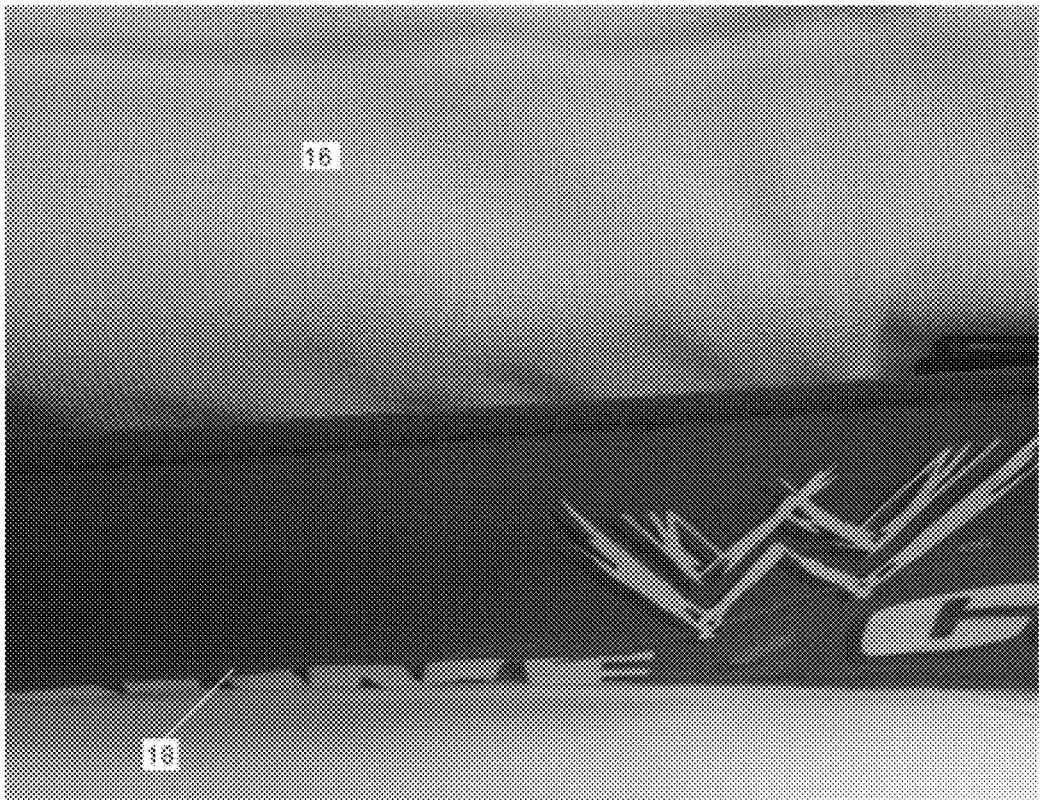
FIG. 9 is a top perspective view of a ring skirt and ring mat assembly in accordance with an embodiment of the present invention.

FIG. 9 is a top perspective view of a ring skirt 18 and ring mat 16 in accordance with an embodiment of the present invention. The ring mat 16 is situated a top the platform 14 (not shown) and may surround the platform much like a bed sheet. The ring skirt 18 is configured to surround the platform 14 and ring mat 16, and attach to portions of the ring mat 16 and/or platform 14 such that segments of the ring skirt 18 abutting the ring mat 16 may be separated while the ring skirt 18 remains attached to the ring 10. The separation in the ring skirt 18 from the ring mat 14 allows for a play pattern replicating various wrestling moves, where the wrestler uses the ring skirt 18 to trap another wrestler, or may escape under the wrestling platform 14, gaining access through the separation in the ring mat 16 and ring skirt 18.

As before, the additional dimension of play allows for greater creativity and enhanced game play for the end user. The ring mat 16 and ring skirt 18 may be fabricated from any suitable material, or combination of materials, including supple natural or synthetic fibers including, cotton, elastomers, polyester, or derivatives thereof. In one embodiment, the ring skirt 18 may be constructed or fitted with an elastic material to allow for resilient separation.

Figure 10:
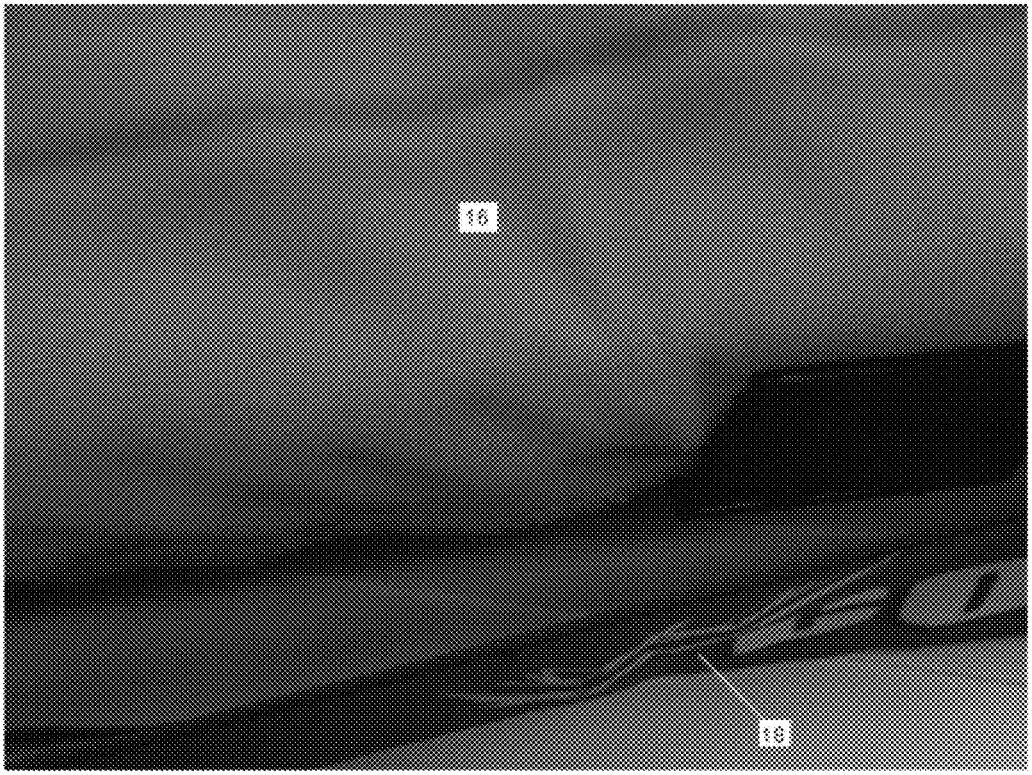
FIG. 10 is a top perspective view of FIG. 9 with the ring skirt pulled away from the ring mat assembly, in accordance with an embodiment of the present invention.

FIG. 10 is a top perspective view of FIG. 9 with the ring skirt pulled away from the ring mat assembly, in accordance with an embodiment of the present invention.

Alternative means to describe the present invention include the following:

A toy ring stage comprising a platform; at least four vertical posts attached to the platform; at least two resilient ropes vertically mounted to the at least four posts; and a turnbuckle pad removably mounted to the rope at the attachment point between the rope and post.

The ring stage above, further comprising a turnbuckle for attaching the rope to the post.

The turnbuckle above, further comprising a sheathing substantially covering the turnbuckle.

The ring stage above, further comprising a ring skirt partially attached to the platform.

The ring skirt above, wherein the ring skirt is configured to separate from the platform, creating a gap between the platform and ring skirt.

The ring stage above, wherein the turnbuckle pad comprises two dimples for contouring the turnbuckle pad to the rope at the attachment point between the rope and post.

The ring stage above, wherein the turnbuckle pad comprises two pair of corresponding fissures at opposing ends of the turnbuckle pad for assembling the turnbuckle pad around the attachment point between the rope and post.

The ring stage above, wherein the turnbuckle pad is configured to contour to the rope to turnbuckle assembly when the turnbuckle pad is assembled.

The ring stage above, further comprising a fastener for assembling the turnbuckle pad, wherein the fastener comprises a base and at least two pegs attached substantially perpendicular to the base.

The fastener above, wherein the two pegs are passed through the corresponding two pair of aligned fissures, of the turnbuckle pad, in assembling the turnbuckle pad.

It is believed that the disclosure set forth above encompasses multiple distinct inventions with independent utility. While each of these inventions has been disclosed in a preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, where any description recites "a" or "a first" element or the equivalent thereof, such disclosure should be understood to include incorporation of one or more such elements, neither requiring nor excluding two or more such elements.

While the invention has been described in detail and with references to specific embodiments thereof, it will be apparent to one skilled in the art that various changes and modifications can be made therein without departing from the spirit and scope of the invention. Thus, it is intended that the present invention covers the modifications and variations of this invention provided they come within the scope of the appended claims and their equivalents. For example, the majority of the elements can be formed of molded plastic. However, in alternative embodiments, the elements can be formed of a material other than plastic provided that the material has sufficient strength for the component's intended function.

What is claimed is:

1. A toy ring, comprising:

a platform;

at least one post coupled to the platform and extending substantially vertically therefrom;

a turnbuckle removably coupled to the post, the turnbuckle including a first loop portion and second loop portion, the first loop portion being engageable with the post;

a rope coupled to the turnbuckle, the rope being engageable with the second loop portion of the turnbuckle; and a turnbuckle pad including two side portions and two dimples where each of the side portions includes one of the dimples, the turnbuckle pad removably mounted to the rope at an attachment point between the rope and post, the turnbuckle pad being located so as to cover a portion of the rope and the second loop portion of the turnbuckle, wherein the two dimples contour the turnbuckle pad to the rope at an attachment point between the rope and the turnbuckle.

2. The toy ring of claim 1, further comprising:

a sheathing substantially covering the turnbuckle.

3. The toy ring of claim 2, wherein at least a portion of the sheathing is covered by the turnbuckle pad when the turnbuckle pad is mounted to the rope.

4. The toy ring of claim 1, wherein one of the first loop portion or the second loop portion is movable relative to the turnbuckle.

5. The toy ring of claim 4, wherein the first loop portion has a different configuration than the second loop portion.

6. The toy ring of claim 1, wherein the turnbuckle pad includes two pairs of corresponding openings at opposing ends of the turnbuckle pad for mounting the turnbuckle pad around the attachment point between the rope and the turnbuckle.

7. The toy ring of claim 6, further comprising:

a fastener for assembling the turnbuckle pad, the fastener including a base and at least two pegs attached to the base, the pegs being insertable into the openings at the opposite ends of the turnbuckle pad to couple the ends of the turnbuckle pad together.

8. A toy ring, comprising:

a platform;

a plurality of posts coupled to the platform;

a plurality of turnbuckles, each turnbuckle having a first end and a second end opposite to its first end, each turnbuckle including a first connector at its first end and a second connector at its second end, the first connector of each turnbuckle being removably coupled to one of the posts;

a rope coupled to each of the turnbuckles, the rope being engageable with the second connector of each of the turnbuckles; and a plurality of turnbuckle pads, each of the turnbuckle pads being removably mounted to the rope at the location where the rope engages one of the turnbuckles, each of the turnbuckle pads having angled side portions with dimples formed therein that facilitate the mounting of the turnbuckle pad to the rope.

9. The toy ring of claim 8, wherein each of the turnbuckle pads includes a first end, a second end opposite to its first end, and a coupler with multiple posts, the posts of each coupler being engageable with a first end and a second end of a turnbuckle pad to couple the ends of the turnbuckle pad together about the rope.

* * * * *